United States Patent [19]

Suissa

[11] Patent Number: 4,879,888

[45] Date of Patent: Nov. 14, 1989

[54] DRY CLEANING MACHINE

[76] Inventor: Moshe Suissa, 5561 Alpine, Côte St Luc, Quebec, Canada, H4V 2X4

[21] Appl. No.: 282,499

[22] Filed: Dec. 12, 1988

[51] Int. Cl.[4] ..... D06F 43/08

[52] U.S. Cl. ..... 68/18 C; 68/18 F; 210/167; 202/170

[58] Field of Search ..... 68/18 R, 18 C, 18 F; 210/663, 167, 391, 407; 202/170

[56] References Cited

U.S. PATENT DOCUMENTS

| | | | |
|---|---|---|---|
| 3,295,689 | 1/1967 | Arvanitakis | 68/18 F X |
| 3,429,148 | 2/1969 | Worthington | 68/18 F |
| 3,497,452 | 2/1970 | Arvanitakis | 68/18 F X |
| 3,522,718 | 8/1970 | Gillespie | 68/18 F X |
| 4,091,643 | 5/1978 | Zucchini | 68/18 F X |
| 4,601,181 | 7/1986 | Privat | 68/18 F |
| 4,712,392 | 12/1987 | Hagiwara et al. | 68/18 F |

*Primary Examiner*—Frankie L. Stinson

*Attorney, Agent, or Firm*—Foley & Lardner, Schwartz, Jeffery, Schwaab, Mack, Blumenthal & Evans

[57] ABSTRACT

An improved dry cleaning machine is disclosed, which comprises a rotating drum, at least one storage tank for a cleaning solvent used in the drum, a pump for circulating the solvent from the tank to the drum through a feed line including a lint collector, a solvent filtration unit including at least one filter through which the solvent may be passed downstream the lint collector, a solvent decoloration unit including a bed of activated carbon through which the solvent may also be passed whenever necessary, and a solvent distillation unit comprising a still, a condenser and a separator. The improvement consists of a regeneration unit incorporated into the machine and comprising a regeneration chamber in which the carbon used in the decoloration unit may be introduced, preheated and reactivated with live steam, whenever desired. Such a regeneration unit permits to substantially reduce the operation cost of the machine, as it avoids the repeated purchase and installation of costly refill power filters and/or carbon cartridges to keep the decoloration unit active. The improvement also consists in the use of a new kind of micro-filtration filter made of fabric in the solvent filtration unit.

14 Claims, 1 Drawing Sheet

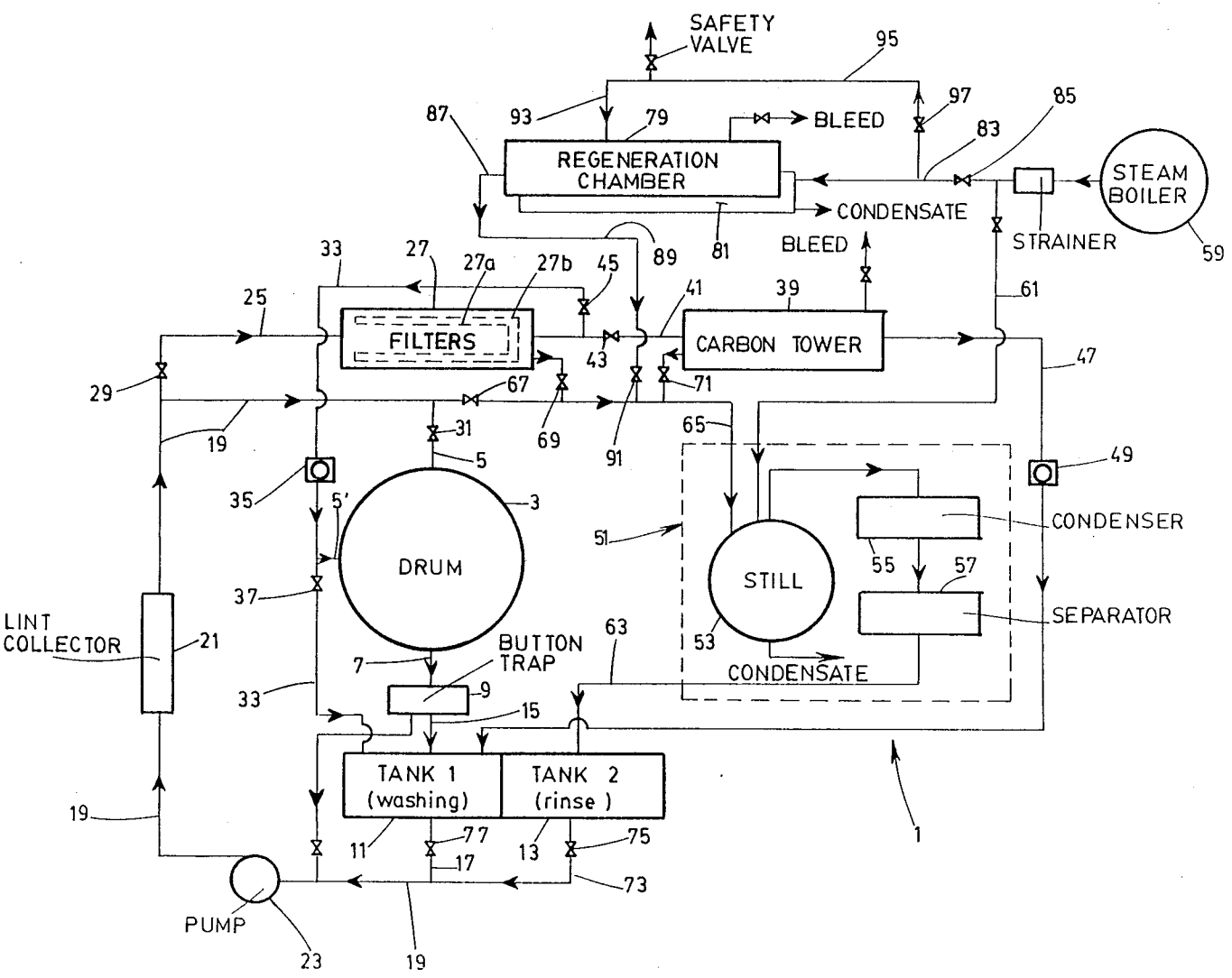
STEAM BOILER
STRAINER
CONDENSER
SEPARATOR
CONDENSATE
BLEED
SAFETY VALVE
REGENERATION CHAMBER
CARBON TOWER
STILL
FILTERS
DRUM
BUTTON TRAP
TANK 1 (washing)
TANK 2 (rinse)
PUMP
LINT COLLECTOR

DRY CLEANING MACHINE

BACKGROUND OF THE INVENTION (a) Field of the Invention

The present invention relates to an improved dry cleaning machine for use in dry cleaning establishments and similar industries.

More particularly, the present invention relates to a dry cleaning machine that incorporates a solvent filtration unit using a new kind of micro-filtration filter and/or a solvent regeneration unit for use to reactivate the carbon powder used to keep the laundry cleaning solvent colorless from batch to batch.

( b) Brief Description of the Prior Art

Dry cleaning machines are machines that are well known per se and used almost everywhere throughout the world. These machines usually comprise a rotating drum in which the laundry to be cleaned is introduced. An organic solvent such as perchloroethylene is injected into the drum while the same is rotating to clean the laundry. This solvent is usually kept into a tank and fed into the drum by means of a pump connected to the tank.

Of course, the solvent also has to be cleaned up from time to time. To do so, most of the dry cleaning machines presently available on the market include means for regenerating and purifying the solvent, such means usually comprising:

(a) a lint collector mounted in-line in the solvent feed line downstream the pump to catch any big particles that could be drained out of the drum during the cleaning operation;

(b) a solvent filtration unit including at least one filter through which the solvent may be passed downstream the lint collector to remove therefrom smaller particles;

(c) a solvent decoloration unit including an activated carbon tower through which the solvent may also be passed whenever necessary (e.g. when the solvent is so "loaded" that it becomes colored); and (d) a solvent distillation unit comprising a still, a condenser and a separator through which part of the solvent may be processed to remove any organic impurities contained therein prior to re-using it for cleaning the garment in the drum.

In the filtration and decoloration units, use has been made up to now of powder filters and/or cartridges that must be replaced from time to time.

The powder filters presently available on the market consist of diatomaceous earth deposited on screens, nylon discs or wovened tubes to form a filtering cake. For decoloration purpose, carbon powder may be added to this basic structure. The major problem of such filters lies in that they are mechanically complicated and dirty. As a result, trained operators are needed to change them and a lot of hazardous waste is generated because of the powder and carbon they contain. As a matter of fact, in use, approximately 1 pound of dirt from the filter(s) may clog the solvent per 100 pounds of garment being processed.

The cartridges are much more convenient than the powder filter. Accordingly, they are in greater use today (they represent 85% of the solvent purification systems presently used in the industry). Their major drawback however is their cost of purchasing and their cost of disposal as a substantial amount of solvent is always trapped into the cartridges and thus disposed therewith.

OBJECTS OF THE INVENTION

A first object of the present invention is to provide an improved dry cleaning machine which includes an improved purification system that is of a very simple structure and operation and does not use nor request any cartridge or powder filter.

Another object of the invention is to provide a dry cleaning machine comprising such an improved purification system that the amount of hazardous waste is reduced by 95% and the loss of solvent is also drastically reduced, thereby causing a simultaneous reduction in the machine operation cost.

A further object of the present invention is to provide a dry cleaning machine comprising such an improved purification system that energy savings are achieved (indeed, as no powder filter or cartridge is used, no stripping is required).

SUMMARY OF THE INVENTION

As most of the existing dry cleaning machines, the dry cleaning machine according to the invention comprises a rotating drum in which the laundry is introduced and processed; at least one storage tank for a cleaning solvent; a pump for circulating the solvent from the tank to the drum through a feed line including a lint collector; a solvent filtration unit including at least one filter through which the solvent may be passed downstream the lint collector; a solvent decoloration unit that may be incorporated into the filtration unit and includes a bed of activated carbon through which the solvent must also to be passed whenever necessary; and in most of the cases, a solvent distillation unit comprising a still, a condenser and a separator.

In accordance with a first embodiment of the invention, the dry cleaning machine disclosed hereinabove is improved over the existing machines of the same type in that it further comprises a regeneration unit incorporated into its structure for use to reactivate the carbon contained in the carbon tower whenever necessary, thereby making it unnecessary to use refill carbon cartridges.

The regeneration unit comprises a regeneration chamber in which the carbon used in the decoloration unit may be introduced from time to time, preheated to remove the liquid solvent contained therein, and then reactivated with live steam derived from a steam generator that may be incorporated in the machine or external.

Such a regeneration unit permits to substantially reduce the operation cost of the machine, as it avoids the repeated purchase and installation of refill power filters and/or carbon cartridges to keep the decoloration unit active.

More particularly, the improved dry cleaning machine according to the first embodiment of the invention as broadly claimed hereinafter comprises:

a rotating drum in which the laundry to be cleaned is treated with a cleaning solvent, said drum having a solvent inlet and a solvent outlet;

at least one storage tank for the solvent, this tank having a solvent inlet and a solvent outlet;

a solvent feed line extending from the outlet of the storage tank to the inlet of the drum, the feed line including a lint collector;

a pump for circulating the solvent from the tank to the drum through the feed line;

a solvent return line extending from the outlet of the drum to the inlet of the storage tank, this return line including a button trap, a solvent filtration unit including at least one filter and means for allowing at least part of the solvent circulating through the feed line downstream the lint collector to pass through this filter to block any mechanical impurities;

a solvent decoloration unit that may be combined with the filtration unit and includes a bed of activated carbon and means for allowing at least part of the solvent having passed through the filter to pass through the carbon bed;

a solvent distillation unit including a still, a condenser, a separator and means for allowing at least part of the solvent having passed through at least the lint collector to be fed into the still and distilled therein, then condensed in the condenser and finally returned to the storage tank via the separator and a return pipe; and a regeneration unit to reactivate the carbon used in the decoloration unit whenever necessary, this regeneration unit comprising:

a chamber in which the carbon to be reactivated is introduced and processed;

means such as a steam jacket for heating the chamber to evaporate the solvent dripping from the carbon to be reactivated and subsequently drying this carbon after the regeneration process has been completed;

means for injecting live steam into the heated chamber to desorb the carbon to be reactivated; and piping means to direct the evaporated solvent and desorbsion steam from the heated chamber to the still of the solvent distillation unit.

In accordance with a second embodiment of the invention, the dry cleaning machine disclosed hereinabove is improved in that its filtration unit does not make use of powder filter(s) or cartridge(s) as is known, but rather comprises two filters mounted in line and each consisting of a bag made of fabric and positioned in such a manner as to extend across the solvent piping to catch the very small particles contained in the solvent when the same flows therethrough. The bag forming the first filter (e.g. the one positioned upstream) is preferably made of a Nylon ® fabric having a fine mesh of about 10 to 25 microns. The bag forming the second filter (i.e. the one positioned downstream) is preferably made of a composite fabric having, in use, a mesh of 1 to 10 microns.

More particularly, the improved dry cleaning machine according to the second embodiment of the invention as broadly claimed hereinafter comprises:

a rotating drum in which the laundry to be cleaned is treated with a cleaning solvent, said drum having a solvent inlet and a solvent outlet;

at least one storage tank for the solvent, said at least one tank having a solvent inlet and a solvent outlet;

a solvent feed line extending from the outlet of said at least one storage tank to the inlet of the drum, said feed line including a lint collector;

a pump for circulating the solvent from said at least one tank to the drum through the feed line;

a solvent return line extending from the outlet of the drum to the inlet of said at least one storage tank, said return line including a button trap, a solvent filtration unit including at least one filter and means for allowing at least part of the solvent circulating through the feed line downstream the lint collector to pass through said at least one filter. In this embodiment, the filtration unit comprises two filters mounted in line and each consisting of a bag made of fabric and wherein the upstream filter has a mesh of about 10 to 25 microns and the downstream filter has a mesh of 1 to 10 microns. Preferably, the lint collector consists of a Nylon bag having a mesh of 50 to 75 microns;

the bag forming the upstream filter of the filtration unit is made of Nylon; and the bag forming the downstream filter of the filtration unit is made of a composite fabric having a multilayered cell structure that swells when the solvent is passing therethrough.

It may be appreciated that both of these fabric bags are very cheap as compared to the powder filters used up to date, and much easier to dispose of. Indeed, as they are made of fabric, they may be dried into the drum of a dryer as any piece of garment before being thrown away.

Of course, the two embodiments of the invention as disclosed hereinabove may be incorporated into a single machine or used separately.

BRIEF DESCRIPTION OF THE DRAWINGS

The invention and its numerous advantages will be better understood upon reading the following, non restrictive description of a preferred embodiment thereof, made with reference to the accompanying drawings wherein the single FIGURE is a flow chart of a dry cleaning machine according to the invention.

DESCRIPTION OF A PREFERRED EMBODIMENT

The dry cleaning machine 1 as shown in the single figure of drawings, comprises a rotating drum 3 in which the laundry to be cleaned is processed with a cleaning solvent. The drum has solvent inlets 5, 5' and a solvent outlet 7 leading to a button trap 9.

The machine also comprises two storage tanks 11, 13, in which the solvent is kept. The first tank 11 has an inlet 15 directly connected to the button trap 9 and an outlet 17 connected to a solvent feed line 19 which extends from the outlet 17 of the tank 11 up to the inlet 5 of the drum. The feed line 19 includes a lint collector 21 that may consist of a Nylon ® bag having a mesh of 50 to 75 microns and whose purpose is to remove the heavy "mechanical" impurities such as lint, hair, pins, stones, etc... that may load the solvent. The feed line 19 also include a pump 23 whose purpose is to circulate the solvent from the tank 11 up to the drum 3 through the feed line 19. Usually, the tank 11 is located under the drum 3 and the button trap 9, to allow the solvent injected into the drum to flow back to the tank by gravity, the drum outlet 7, button trap 9 and tank inlet 15 thus forming altogether a solvent return line.

From time to time, it is compulsory to remove the other mechanical impurities of smaller sizes that may load the solvent without being big enough to get caught in the lint collector 21. To do so, use is made of a solvent filtration unit forming part of the machine. This filtration unit comprises a solvent derivation line that is connected to the feed line 19 downstream the lint collector 2 and leads to a filtration chamber 27. Whenever desired, a valve 29 located in the derivation line 25 may be opened to allow the solvent passing through the feed line 19 or part of it to enter into the filtration chamber 27. When all the solvent passing through the feed line 19 has to be treated in the filtration unit, another valve 31 located in the drum inlet 5 may be closed to force the solvent to pass through the derivation line 25 exclusively.

In accordance with a first original aspect of the invention, the filtration chamber 27 comprises two filters *27a, 27b,* each consisting of a bag made of fabric and positioned in such a manner as to extend across the chamber 27 to trap the mechanical impurities contained in the solvent. The first bag *27a* mounted upstream in the filtration chamber 27 is preferably made of a fine Nylon ® fabric whose mesh is of bout 10 to 25 microns. The second bag *27b* which is mounted over the first one and thus downstream the same, is preferably made of a composite fabric having a mesh of 1 to 10 microns.

As composite fabric, use can preferably be made of a polypropylene fabric having a multi-layered cell structure that swells when the solvent is passing therethrough. Such a swelling of course increases the filtration surface area of the fabric and reduce its mesh to the desired value to achieve micro-filtration.

This double filtration system which acts as second and third filtration stages after the lint collector filtration stage, advantageously permits to trap the biggest particles in the first bag and the smallest particles that may have passed through the first bag *27a* in the second bag *27b*.

The main advantages of using such bag filters are, on the one hand, their low cost as compared to the powder filters and/or cartridges used up to now and, on the other hand, their capacity of being cleaned, dried and recycled as any piece of cloth whenever necessary. if desired, clays or silicated filters may be added to the filtration chamber depending on application.

The filtered solvent at the outlet of the filtration chamber 27 may be returned either to the drum 3 via the inlet 5' or to the tank 11 via a line 33 that is provided with a window 35 and a valve 37. The purpose of the window 35 is to allow the operator of the machine to watch the colour of the solvent passing through the line 33 after filtration. The purpose of the valve 37 which is located downstream the drum inlet 5' is to force the solvent to enter the drum 3 whenever desired, instead of returning to the tank 11.

The machine 1 further comprises a solvent decoloration unit through which the solvent may also be passed whenever necessary, when some impurities or organic dyes are dissolved therein, and have altered its colour.

The decoloration unit comprises a carbon tower 39 fed by another derivation line 41 connected to the line 33 at the outlet of the filtration chamber 27. To allow the solvent or part of the solvent passing through the line 33 to enter the line 41 and pass through the carbon tower 39, a valve 43 mounted in the line 41 may be opened while, simultaneously, a valve 45 mounted in the line 33 is closed entirely or partially.

The carbon tower 39 is filled up with an activated carbon bed whose purpose is to adsorb the "colors" that bleed from the laundry and change the color of the solvent. The solvent at the outlet of the carbon tower 39 is returned to the tank 11 via a line 47 that is also provided with a window 49 to check whether the decoloration process in the carbon tower 30 is completed.

The machine further comprises a solvent distillation unit 51 including a still 53, a condenser 55 and a separator 57 connected to each other as is known in the art.

The still 53 comprises an external heating jacket (not shown) whose heating source may be steam coming from an external steam source (not shown) whenever such a source is available or coming from a steam boiler 59 forming part of the machine, via a steam feeding line 61. This still 53 is intended to be used to distill the solvent in order to remove the organic impurities that may be contained therein after a while, in the form of a condensate that may be disposed off. The distillate escaping on top of the still is then condensed in the condenser 55 and returned to the second tank 13 via the separator 57 and a return pipe 63.

The still 53 is fed by a main solvent drain line 65 that may be connected to the feed line 19 downstream the lint collector 21 by means of a valve 67, or to an outlet of the filter chamber 27 by means of another valve 69, or to an outlet stood, the main solvent drain line 65 may also be used to drain off the filtration chamber 27 and carbon tower 29 whenever necessary, by mere opening of the valves 69 and 71, respectively.

As already indicated, the distilled solvent which is very pure, is returned by the pipe 63 to the second tank 13, rather than the first tank 11. This particular arrangement is of a great interest as it makes it possible to use the solvent in the first tank 11 as a "washing" solvent and the one which is pure in the second tank 13 as a "rinse" solvent. To circulate the rinse solvent, the second tank 13 has an outlet 73 connectable to the solvent feed line 19 via a valve 75. Of course, when the valve 75 is opened, it is compulsory to close the outlet 17 of the first tank 11, using another valve 77 mounted in the outlet 17 to do so.

In accordance with another original aspect of the invention, the machine 1 further comprises a regeneration unit forming part of its structure, to reactivate the carbon bed used in the carbon tower 39 whenever necessary (e.g. when the carbon is so saturated that it cannot adsorb anymore the coloring impurities).

This regeneration unit comprises a regeneration chamber 79 in which the carbon to be reactivated (e.g. the one used in the carbon tower 39) may be introduced and processed. usually, transfer of the carbon from the carbon tower 39 to the regeneration chamber 79 can be made manually by the operator.

Means are provided for heating the chamber 79 to evaporate the solvent dripping from the carbon to be reactivated prior to starting the regeneration process. This heating means preferably consists of a jacket 81 forming part of the chamber 79, which jacket is connectable to the steam boiler 59 (or an external steam source) via a steam supply line 83 closable with a valve 85. The condensate that is formed into the jacket 81 when the same is fed with steam, may be drained off through the same drain as the condensate of the still 53.

The regeneration chamber 79 is provided with an outlet 87 connected to a pipe 89 leading to the main solvent drain line 65 via a valve 91. It is also provided with an inlet 93 connected to another steam supply line 95 connectable via a valve 97 to the line 83. The purpose of this line 95 is to allow injection of live steam coming from the steam boiler 59 into the regeneration chamber 79 in order to desorb the carbon introduced therein and thus reactivate it, thereby making it possible to re-use it in the carbon tower 39. Of course, the evaporated solvent and desorbtion steam may be removed from the heated chamber via the pipe 89 leading to the still 53 via the main solvent drain line 65, thereby reducing to a minimum extent the amount of solvent lost during the regeneration process.

In use, the solvent contained in the first tank 11 and second tank 13 are fed alternatively into the drum to clean the laundry. From time to time, the solvent pumped through the lint collector 21 whose purpose is essentially to retain particles such as lint, pins, stones, etc. may be fed by the line 25 into the filtration chamber 27. In this chamber, the solvent flows through the first bag 27*a* which retains any particles bigger than 10 microns. Then, it flows through the second bag 27*b* acting as a micro-filter capable of retaining particles as small as 1 micron. Of course, the solvent must be circulated through the filter and then back to the tank 11 as long as necessary to obtain the required clarity when it passes in front of the glass window 35.

If the solvent is colored, the valve 43 may be opened by a switch while the valve 45 is closed in order, to direct the solvent from the filtration chamber 27 to the carbon tower 39. Circulation through the carbon tower 39 must of course be continued to as long as necessary to achieve complete decoloration. The decoloration process may be checked through the window 49 provided in the return line 47. Whenever necessary, the solvent from either the lint collector 21, the filtration chamber 27 or the carbon tower 39 may be fed into the distillation unit 51 to remove the organic impurities that are dissolved therein and cannot be removed by filtration and/or adsorption.

When the carbon contained in the carbon tower 39 reaches a saturation point (no color removal), it must be removed and replaced by reactivated carbon. Such a regeneration is carried out in the regeneration chamber 79 that may consist of a stainless steel housing corporating the heating jacket 81. When the saturated carbon has been placed into the regeneration chamber and the same has been sealed, an electric control (not shown) may be activated to open the valve 85 and thus allow steam from the boiler 59 to enter the jacket 51 and heat the chamber 79. Such a heating of the chamber causes evaporation of the solvent dripping from the carbon particles. It also causes the space over the carbon particles to be heated to improve the desorption process. Then, the valve 97 opens to inject live steam in the center of the carbon bed through a plurality of nozzles (not shown), via the steam supply line 95.

The live steam desorbs the dyes from the carbon granules. The live steam injection may be adjustable from 5 minutes to 1 hour at pressures that may vary from 5 to 15 psi. The steam vapor that carries the solvent is fed to the still 53 via the pipe 89. Of course, in the still 53, these vapors are distilled to recover the solvent.

In use, heating of the regeneration chamber is continued after the injection of live steam, until the carbon granules are completely regenerated and the carbon is fully dried. It may take from 1 to 3 hours. The regeneration carbon is then ready to be reused in the carbon tower.

As aforesaid, all the above mentioned steps may be preprogrammed and automatized as it is known in this art, so that operation of the whole machine and activation of each of its units be achieved with a minimum of switches easy to turn on.

Of course, it must be understood that the improved filtration unit and/or regeneration unit according to the invention may be used independently of each other. It must also be understood that they may be sold independently from a brand-new machine, for installation into an existing machine.

The embodiments of the invention in which an exclusive property or privilege is claimed are defined as follows:

1. In a dry cleaning machine of the type comprising:

a rotating drum in which the laundry to be cleaned is treated with a cleaning solvent, said drum having a solvent inlet and a solvent outlet;

at least one storage tank for the solvent, said at least one tank having a solvent inlet and a solvent outlet;

a solvent feed line extending from the outlet of said at least one storage tank to the inlet of the drum, said feed line including a lint collector;

a pump for circulating the solvent from said at least one tank to the drum through the feed line;

a solvent return line extending from the outlet of the drum to the inlet of said at least one storage tank, said return line including a button trap, a solvent filtration unit including at least one filter and means for allowing at least part of the solvent circulating through the feed line downstream the lint collector to pass through said at least one filter;

a solvent decoloration unit including a bed of activated carbon and means for allowing at least part of the solvent having passed through said at least one filter to pass through said at least one filter to pass through said carbon bed; and a solvent distillation unit including a still, a condenser, a separator and means for allowing at least part of the solvent having passed through at least the lint collector to be fed into the still and distilled therein, then condensed in the condenser and finally returned to said at least one storage tank via the separator and a return pipe;

the improvement wherein the machine further comprises:

a regeneration unit to reactivate the carbon used in the carbon tower whenever necessary, said regeneration unit comprising:

a chamber in which the carbon to be reactivated is introduced and processed;

means for heating the chamber to evaporate the solvent dripping from the carbon to be reactivated and subsequently drying said carbon after the regeneration process has been completed, means for injecting live steam into the heated chamber to desorb the carbon to be reactivated; and piping means to direct the evaporated solvent and desorbsion steam from the heated chamber to the still of the solvent distillation unit.

2. The improved machine of claim 1, wherein said means for heating the chamber of the regeneration unit comprises jacket forming part of the chamber and means for passing steam into said jacket.

3. The improved machine of claim 2, further comprising:

means for supplying steam to said means for passing steam into the jacket and said means for injecting live steam into the chamber respectively; and means connected to said steam supplying means for operating the still of the distillation unit.

4. The improved machine of claim 3, further comprising:

a main solvent drain line leading to the still of the distillation unit; and valve means for connecting any of said lint collector, said at least one filter and said carbon tower to said drain line whenever required.

5. The improved machine of claim 4, comprising:

first and second solvent storage tanks;

valve means for selectively connecting the solvent feed line to either of the outlets of said first and second tanks; and wherein the solvent return line is connected to the inlet of said first tank and the return pipe of the distillation unit is connected to the inlet of the second tank.

6. The improved machine of claim 1, wherein the filtration unit comprises two filters mounted in line and each consisting of a bag made of fabric and wherein the upstream filter has a mesh of about 10 to 25 microns and the downstream filter has a mesh of 1 to 10 microns.

7. The improved machine of claim 6 wherein:

the lint collector consists of a Nylon bag having a mesh of 50 to 75 microns;

the bag forming the upstream filter of the filtration unit is made of Nylon; and the bag forming the downstream filter of the filtration unit is made of a composite fabric having a multi-layered cell structure that swells when the solvent is passing therethrough.

8. The improved machine of claim 4, wherein the filtration unit comprises two filters mounted in line and each consisting of a bag made of fabric and wherein the upstream filter has a mesh of about 10 to 25 microns and the downstream filter has a mesh of 1 to 10 microns.

9. The improved machine of claim 8, wherein:

the lint collector consists of a Nylon bag having a mesh of 50 to 75 microns;

the bag forming the upstream filter of the filtration unit is made of Nylon; and the bag forming the downstream filter of the filtration unit is made of a composite fabric having a multi-layered cell structure that swells when the solvent is passing therethrough.

10. The improved machine of claim 3, wherein the filtration unit comprises two filters mounted in line and each consisting of a bag made of fabric and wherein the upstream filter has a mesh of about 10 to 25 microns and the downstream filter has a mesh of 1 to 10 microns.

11. The improved machine of claim 10, wherein:

the lint collector consists of a Nylon bag having a mesh of 50 to 75 microns;

the bag forming the upstream filter of the filtration unit is made of Nylon; and the bag forming the downstream filter of the filtration unit is made of a composite fabric having a multi-layered cell structure that swells when the solvent is passing therethrough.

12. The improved machine of claim 1 wherein the filtration unit comprises two filters mounted in line and each consisting of a bag made of fabric and wherein the upstream filter has a mesh of about 10 to 25 microns and the downstream filter has a mesh of 1 to 10 microns.

13. The improved machine of claim 12, wherein:

the lint collector consists of a Nylon bag having a mesh of 50 to 75 microns;

the bag forming the upstream filter of the filtration unit is made of Nylon; and the bag forming the downstream filter of the filtration unit is made of a composite fabric having a multi-layered cell structure that swells when the solvent is passing therethrough.

14. In a dry cleaning machine of the type comprising:

a rotating drum in which the laundry to be cleaned is treated with a cleaning solvent, said drum having a solvent inlet and a solvent outlet;

at least one storage tank for the solvent, said at least one tank having a solvent inlet and a solvent outlet;

a solvent feed line extending from the outlet of said at least one storage tank to the inlet of the drum said feed line including a lint collector;

a pump for circulating the solvent from said at least one tank to the drum through the feed line;

a solvent return line extending from the output of the drum to the inlet of said at least one storage tank, said return line including a button trap.

a solvent filtration unit including at least one filter and means for allowing at least part of the solvent circulating through the feed line downstream of the lint collector to pass through said at least one filter;

the improvement wherein said filtration unit comprises two filters mounted in line and each consisting of a bag made of fabric;

the upstream filter has a mesh of about 10 to 25 microns and the downstream filter has a mesh of 1 to 10 microns;

the lint collector consists of a Nylon bag having a mesh of 50 to 75 microns;

the bag forming the upstream filter of the filtration unit is made of Nylon; and the bag forming the downstream filter of the filtration unit is made of a composite fabric having a multi-layered cell structure that swells when the solvlent is passing therethrough.

* * * * *